US007494758B2

(12) United States Patent
Tsujino et al.

(10) Patent No.: US 7,494,758 B2
(45) Date of Patent: Feb. 24, 2009

(54) PROCESS FOR PRODUCING TONER PARTICLES

(75) Inventors: Takeshi Tsujino, Toride (JP); Satoshi Iki, Mishima (JP); Yoshinori Tsuji, Shizuoka-ken (JP); Shinya Matsumura, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 412 days.

(21) Appl. No.: 11/335,648

(22) Filed: Jan. 20, 2006

(65) Prior Publication Data

US 2006/0177759 A1 Aug. 10, 2006

(30) Foreign Application Priority Data

Jan. 24, 2005 (JP) ..... 2005-014974

(51) Int. Cl.
*G03G 9/08* (2006.01)

(52) U.S. Cl. ..... 430/137.15; 430/137.1

(58) Field of Classification Search ..... 430/137.15, 430/137.1

See application file for complete search history.

(56) References Cited

U.S. PATENT DOCUMENTS 5,272,034 A 12/1993 Kawano et al. ..... 430/137
6,309,788 B1 * 10/2001 Tsuji et al. ..... 430/137.17
2003/0175610 A1 * 9/2003 Kitani et al. ..... 430/109.3

FOREIGN PATENT DOCUMENTS

JP 05-034976 2/1993
JP 08-069126 3/1996

* cited by examiner

*Primary Examiner*—John L Goodrow
(74) *Attorney, Agent, or Firm*—Fitzpatrick, Cella, Harper & Scinto

(57) ABSTRACT

In a process for producing toner particles by granulation carried out in an aqueous medium, a process for producing toner particles is provided which toner particles have a sharp particle size distribution and can achieve a high image density.

In a process for producing toner particles to be obtained by granulating in an aqueous medium a colorant composition containing at least a colorant, an apparatus which forms the toner particles by granulation has a granulation tank and a stirrer, and, where the internal volume of the granulation tank is represented by A (L) and the volume of an air layer portion in the interior of the granulation tank by B (L), the air layer portion proportion B/A satisfies the following expression (1):

$$0.05 \geqq B/A \quad (1).$$

8 Claims, 2 Drawing Sheets

PROCESS FOR PRODUCING TONER PARTICLES

BACKGROUND OF THE INVENTION

1. Field of the Invention

This invention relates to a process for producing toner particles for rendering electrostatic latent images visible in image forming processes such as electrophotography, electrostatic recording, magnetic recording and toner jet recording.

2. Related Background Art

A number of methods are conventionally known as methods for electrophotography. In general, they are methods in which copied images are obtained by forming an electrostatic latent image on a photosensitive member by utilizing a photoconductive material and by various means, developing the latent image by the use of a toner to form a toner image, subsequently transferring the toner image to a transfer material such as paper as occasion calls, and then fixing the toner image thereto by the action of heat and/or pressure, solvent vapor or the like. As methods by which the electrostatic latent image is developed by the use of a toner or methods by which the toner image is fixed, various methods have been proposed, and methods have been employed which are suited for their corresponding image forming processes. In recent years, such electrophotographic processes are required to achieve higher-speed copying and higher image quality.

In general, the following processes are known as processes for producing toners. One of them is a process in which a colorant such as a dye or a pigment and additives such as a charge control agent are melted and mixed in a thermoplastic resin to effect uniform dispersion, followed by pulverization and classification by means of a fine grinding machine and a classifier to produce a toner having the desired particle diameter; i.e., a pulverization process.

In the production of a toner by such a pulverization process, there are restrictions where a releasing substance such as wax is added. More specifically, such restrictions are such that, in order to make the releasing substance have dispersibility at a satisfactory level, the releasing substance must keep its viscosity to a certain degree at the temperature at which it is kneaded with the resin, and that the releasing substance is kept in a content of about 5 parts by mass based on 100 parts by mass of the toner. Because of these restrictions, there is a limit to the fixing performance of the toner obtained by the pulverization process.

In such a pulverization process, it is also not easy to make fine solid particles such as the colorant perfectly uniformly dispersed in the resin, and the toner may come compositionally distributed depending on the degree of dispersion to cause variations of developing performance of the toner.

In the toner obtained by this pulverization process (hereinafter also "pulverization toner"), the step of classification is essential in order to attain stated particle diameter and particle size distribution, and, through this step, fine powder and coarse powder come in addition to the toner with stated particle diameter. Accordingly, various ideas are made on how to reuse them in production. The coarse powder is again pulverized in the production step to become finely pulverized. However, conventionally, the toner fine powder that has come has been reused by the recycling to the raw-material mixing step in its stated quantity from the viewpoint of environment and production cost (see, e.g., Japanese Patent Application Laid-open No. H05-34976). In this method, however, the molecules of the resin in the fine toner powder become again cut when the fine toner powder is again melt-kneaded with a kneading machine, to make the resin component have a low molecular weight. Hence, this causes hot offset or the like at the time of fixing of toner to paper to make fixing performance poor, undesirably.

In order to remedy such disadvantages, various ideas have been proposed in regard to the reuse of toner components, and the reuse of the fine toner powder by introducing it into the kneading step is in wide practice as a known technique from the viewpoint of how to produce toners well economically and in a good productivity (see, e.g., Japanese Patent Application Laid-open No. H08-69126). However, even in the recycling carried out by the above method or the like, the fine powder and coarse powder coming at the time of the classification step is commonly in a proportion of about 50 to 70% to the raw materials. Thus, the yield itself as a product is low, and is not preferable in view of production cost.

Against such a pulverization process, a toner production process is also proposed in which a polymerizable monomer composition having at least a polymerizable monomer is subjected to suspension polymerization to obtain toner particles simultaneously therewith (a suspension polymerization process). This suspension polymerization process is a production process as described below. First, a polymerizable monomer and a colorant (further optionally a polymerization initiator, a cross-linking agent and other additives) are uniformly dissolved or dispersed to obtain the polymerizable monomer composition. Then, this polymerizable monomer composition is dispersed in a continuous phase (e.g., an aqueous phase) containing a dispersion stabilizer, by means of a suitable stirrer to carry out polymerization reaction simultaneously to obtain toner particles having the desired particle diameter. This suspension polymerization process is free from the restrictions as stated on the above pulverization toner, and has various advantages.

More specifically, in regard to the content and dispersibility of a release agent (releasing substance), the toner obtained by the suspension polymerization process (hereinafter also "polymerization toner") enables the release agent component to be enclosed in the toner particles, and hence its content can be made larger than that in the toner produced by the pulverization process. It can also satisfy the dispersibility simultaneously. Also, the dispersibility of the colorant does not particularly come into question because the colorant can uniformly be dissolved or dispersed in the polymerizable monomer together with other additives.

However, this polymerization toner as well has problems as stated below, which should be solved. In the suspension polymerization process, in the step of granulation which forms the toner particles, the polymerizable monomer composition is made into droplets and the toner particles come to be formed, in virtue of the shearing force produced by the rotation of stirring blades. It is preferable that the toner particles obtained here have a sharp particle size distribution. The feature that the toner particles have a sharp particle size distribution is an essential condition in order for the toner to exhibit a good developing performance. In general, in order to make the toner particles have a sharp particle size distribution, it is effective to make the stirring blades rotated in a high speed to impart a high shearing force. However, as the stirring blades are rotated in a higher speed, a vortex comes to be formed around the stirring blades, so that air bubbles begin to be incorporated into the materials being treated. Hence, the loss of shearing force comes about in proportion to the speed made higher. In order to prevent this, it is effective to provide a baffle or the like, which, however, is not sufficiently effective. Also, as the stirring blades are rotated in a higher speed, cavitation begins to take place around the stirring blades.

Hence, at a certain number or more of revolutions, the particle size may no longer become sharper to make the particle size distribution poor. Thus, although it is an effective means to make the stirring blades rotated in a higher speed in order to make the toner particles have a sharper particle size distribution, such a means may even bring about a reverse effect at a certain number or more of revolutions. Hence, there is a limit in making the particle size distribution sharp.

Meanwhile, depending on the concentration of a dispersant used in the aqueous phase in order to provide a sharp particle size distribution width and on the conditions under which it is added, polymerization may concurrently occur in the aqueous phase to form ultrafine particles of 0.1 to 1 μm in particle diameter or smaller in size than that. Such ultrafine particles make non-uniform the dispersibility of the colorant and so forth in those particles, and the presence of the ultrafine particles makes the toner cause problems on image characteristics (solid density, density uniformity, fog and so forth). Further, once such ultrafine particles have adhered to toner particle surfaces, the toner may change in its fluidity and charge controllability, and hence this likewise makes the toner cause problems on image characteristics.

With a trend toward higher image quality in electrophotography, the particle size distribution required in the polymerization toner is also required to be made much sharper. However, in existing techniques, however the conditions for granulation are optimized, it may become necessary to lessen the proportion of fine particles of 4 μm or less in particle diameter and coarse particles of 10 μm or more in particle diameter through the step of classification.

From another point of view, in the polymerization toner, particles are also commonly so designed as to have a core-shell structure having at least two layers, in which the releasing component, low-energy fixing component and so forth stand enclosed in toner particles. Hence, even where toner particles outside the range of stated particle size distribution or particle size distribution width have been formed in any form, they can not be reused in such a simple way as in the pulverization toner. Thus, the fine particles and coarse particles formed as by-products at the time of the classification step have caused a rise in cost.

SUMMARY OF THE INVENTION

An object of the present invention is to provide a process for producing toner particles having solved the problems discussed as above. More specifically, the present invention aims to provide, in a process for producing toner particles to be obtained by granulation carried out in an aqueous medium, a process for producing toner particles which have a sharp particle size distribution and can achieve a high image density.

As a result of extensive studies, the present inventors have discovered that the particle size distribution can be made sharp by a granulation process in which the air bubbles are kept from being incorporated and the cavitation from taking place in the step of granulation that forms the toner particles, and also the toner particles obtained can achieve a high image density. Thus, they have accomplished the present invention.

That is, the present invention provides a process for producing toner particles to be obtained by granulating in an aqueous medium a colorant composition containing at least a colorant, wherein an apparatus which forms the toner particles by granulation has a granulation tank and a stirrer, and, where the internal volume of the granulation tank is represented by A (L) and the volume of an air layer portion in the interior of the granulation tank by B (L), the air layer portion proportion B/A satisfies the following expression (1):

$$0.05 \geqq B/A \quad (1).$$

DESCRIPTION OF THE PREFERRED EMBODIMENTS

A process for producing toner particles having a sharp particle size distribution and a superior economical advantage can be provided in the step of granulation in the course of producing the toner particles.

The process for producing toner particles according to the present invention is, in a process for producing toner particles to be obtained by granulating in an aqueous medium a colorant composition containing at least a colorant, characterized in that an apparatus which forms the toner particles by granulation has a granulation tank and a stirrer, and, where the internal volume of the granulation tank is represented by A (L) and the volume of an air layer portion in the interior of the granulation tank by B (L), the air layer portion proportion B/A satisfies the following expression (1):

$$0.05 \geqq B/A \quad (1).$$

Figure 1:
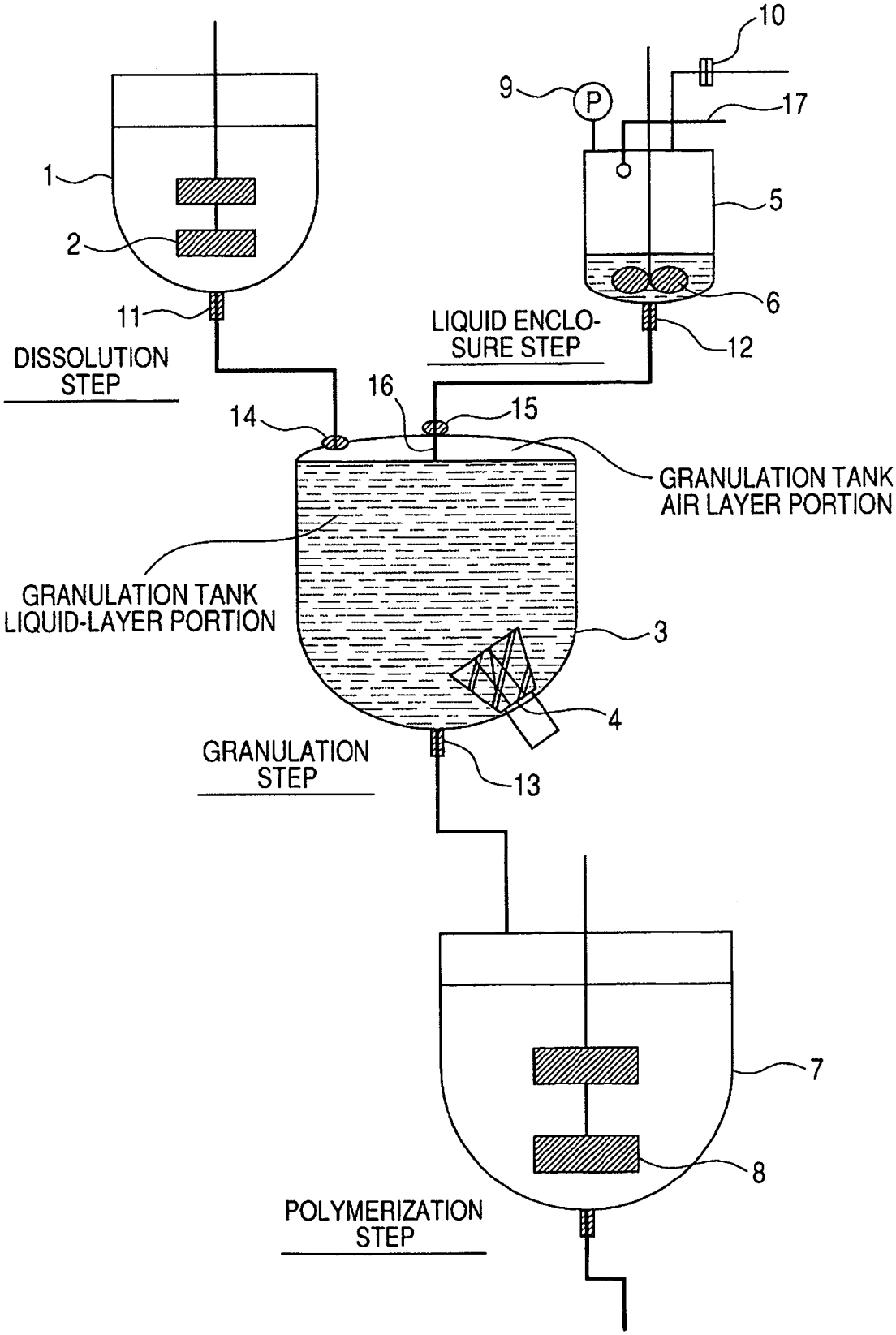
FIG. 1 is a view showing an example of a flow chart showing an entire flow of the production process of the present invention.

FIG. 1 shows a preferred example of a system used in the present invention, to which, however, the example is by no means limited. The present invention may be used in a solution suspension process and a suspension polymerization process. It may preferably be used in the suspension polymerization process. Incidentally, FIG. 1 shows a process for producing toner particles in which the present invention is applied to the suspension polymerization process. In FIG. 1, reference numeral 1 denotes a dissolution tank; 2, a dissolution stirrer; 3, a granulation tank; 4, a granulation stirrer; 5, a liquid enclosure tank; 6, a liquid enclosure tank stirrer; 7, a polymerization tank; 8, a polymerization stirrer; 9, a pressure gauge; 10, a pressure control valve; and 11, a dissolution discharge valve. Also, in FIG. 1, reference numeral 12 denotes a liquid enclosure discharge valve; 13, a granulation discharge valve; 14, a granulation tank valve (1); 15, a granulation tank valve (2); 16, an inner cylinder; and 17, a hot-water shower line.

Figure 2:
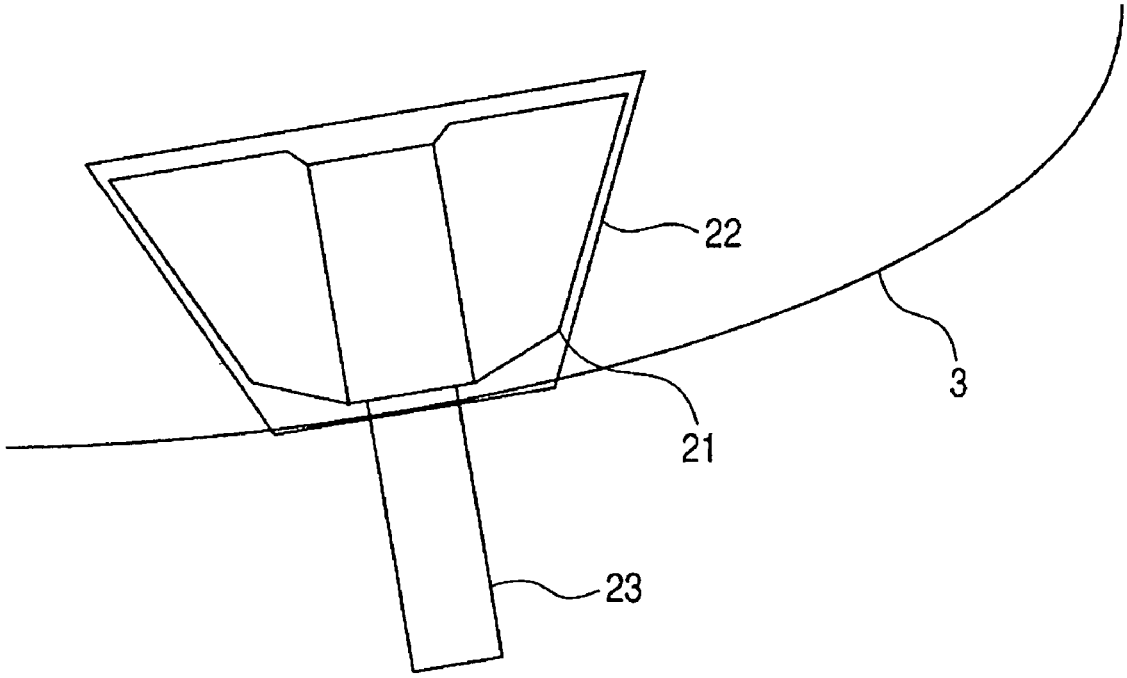
FIG. 2 is a diagrammatic sectional view showing an example of a granulation unit preferably usable in the production process of the present invention.

FIG. 2 is also a schematic view of a preferred granulation stirrer 4 used in the granulation step in the present invention. In FIG. 2, reference numeral 21 denotes stirring blades; 22, a stirring chamber; and 23, a stirring shaft.

A preferred embodiment of the production process of the present invention is described below with reference to FIG. 1.

In the granulation tank 3, a liquid dispersion medium is prepared, and thereafter the colorant composition containing at least a colorant is introduced from the dissolution tank 1 into the granulation tank 3. Incidentally, the colorant composition may further contain a polymerizable monomer. Next, an aqueous medium is introduced from the liquid enclosure tank 5 into the granulation tank 3. Here, the inner cylinder 16 is provided beneath the granulation tank valve (2), and the length of the inner cylinder 16 is adjusted so that the proportion of the air layer portion in the interior of the granulation tank 3 can be controlled at will. The aqueous medium is also introduced into the interior of the liquid enclosure tank 5 and the interior of a pipe through which the liquid enclosure tank 5 communicates with the granulation tank 3. Here, from 5 to 50% of the internal volume of the liquid enclosure tank 5 may preferably be held by the aqueous medium. Incidentally, the aqueous medium may contain a polymerizable monomer.

Thereafter, an air layer portion in the liquid enclosure tank 5 is pressurized by feeding an inert gas or air until it comes to have a stated pressure. After the air layer portion has been pressurized until the liquid enclosure tank 5 and the granulation tank 3 comes to have the same pressure, the granulation is started.

Here, where the internal volume of the granulation tank 3 is represented by A (L) and the volume of the air layer portion in the interior of the granulation tank by B (L), the air layer portion proportion B/A must satisfy the following expression (1):

$$0.05 \geqq B/A \quad (1).$$

It is further preferable that the air layer portion proportion B/A satisfies the following expression (2):

$$0.01 \geqq B/A \quad (2).$$

Thus, controlling the air layer portion proportion B/A in the granulation tank 3 to be 0.05 or less causes the air bubbles to be hardly incorporated, so that the shearing force produced by the granulation stirrer 4 can be efficiently be imparted to the materials being treated. Further, the flow of the materials being treated in the tank is uniform compared with a case in which the air layer portion is present in a proportion more than 0.05, and hence the toner particles produced can have a sharp particle size distribution. Incidentally, the granulation tank internal volume A may preferably be from 50 L (liters) or more to 50,000 L or less. Also, the volume B of the air layer portion in the interior of the granulation tank may preferably be so controlled as to be 5% or less of the granulation tank internal volume A. More desirably, the volume B of the air layer portion in the interior of the granulation tank may preferably be so controlled as to be 1% or less of the granulation tank internal volume A.

As described above, in order to make the toner particles have a sharp particle size distribution, it is important to bring the air layer portion proportion B/A in the granulation tank 3 into a state of 0.05 or less.

Bringing the interior of the granulation tank 3 into a pressurized state can also keep the stirring blades 21 being rotated at high speed, from any abrupt change in pressure at its periphery, and hence the fine particles to be caused by the cavitation can be prevented from being formed, and this enables the toner particles to have a much sharper particle size distribution.

To bring the interior of the granulation tank 3 into a pressurized state, it is preferable that the air layer portion in the interior of the liquid enclosure tank 5 communicating with the upper part of the granulation tank 3 is pressurized to make that portion have a stated pressure and this pressure is maintained. Compared with a case in which the interior of the granulation tank 3 is directly pressurized, the case in which the interior of the granulation tank 3 is indirectly pressurized by the air layer portion of the liquid enclosure tank 5 is preferable in view of the following. That is, the air layer portion of the liquid enclosure tank 5 functions as a buffer against any variations of pressure which are due to temperature changes in the interior of the granulation tank 3, gases generated from the reaction product, and so forth. Hence, the pressurized state can be maintained with ease, and this is preferable also in view of safety.

Gauge pressure C (kPa) at the time the air layer portion of the liquid enclosure tank is pressurized may preferably be in the range of the following expression (3):

$$100\ (\text{kPa}) \leqq C \leqq 800\ (\text{kPa}) \quad (3).$$

The gauge pressure C (kPa) at which the air layer portion of the liquid enclosure tank is pressurized may more preferably be in the range of the following expression (4):

$$190\ (\text{kPa}) \leqq C \leqq 400\ (\text{kPa}) \quad (4).$$

If the gauge pressure C is less than 100 kPa, the effect of controlling the cavitation may become so weak as to make it difficult for the toner particles to have a sharp particle size distribution.

If the gauge pressure C is more than 800 kPa, the liquid enclosure tank 5 and the granulation tank 3 must be made to have a large thickness, and hence this is not preferable because it is difficult to make temperature control in the interiors of the tanks and because a high investment cost may result.

The stirring blades 21 may also preferably be rotated at a peripheral speed of from 17 to 40 m/sec., and more preferably from 25 to 35 m/sec.

If the stirring blades 21 are at a peripheral speed of less than 17 m/sec., an insufficient shearing force may result, and hence it is difficult for the toner particles to have a sharp particle size distribution. If the stirring blades 21 are at a peripheral speed of more than 40 m/sec., a motor of the stirring blades 21 must be made to have a large power, and hence this brings about a rise in investment cost and running cost, undesirably.

The liquid enclosure tank 5 may also preferably communicate with the upper part of the granulation tank 3. Inasmuch as the liquid enclosure tank 5 communicates with the upper part of the granulation tank 3, the air layer portion in the interior of the granulation tank 3 can readily be displaced with the aqueous medium, and a state can be brought in which substantially no air layer portion is present.

Furthermore, an air escape line leads through the upper part of the liquid enclosure tank and the upper part of the granulation tank 3. Such an air escape line enables the stirring tank air layer portion to be readily displaced with the aqueous medium.

It is also preferable that, where the temperature of a liquid in the granulation tank is represented by D (° C.), and the temperature of a liquid in the liquid enclosure tank by E (° C.), D and E satisfy the following expression (5):

$$(D-30(^\circ\text{C.})) \leqq E \leqq (D+30(^\circ\text{C.})) \quad (5).$$

If they do not satisfy the above expression (5), the difference in temperature between the temperature D (° C.) of a liquid in the granulation tank and the temperature E (° C.) of a liquid in the liquid enclosure tank is so large as to cause convection of the materials being treated and aqueous medium between both the tanks. Because of this, materials being treated which have insufficiently been granulated may inevitably flow into the liquid enclosure tank, undesirably.

As the granulation stirrer 4, it may include the following stirrers. For example, it may include ULTRATALUX (manufactured by IKA Works, Inc.), POLYTRON (manufactured by Kinematica AG), TK AUTOHOMOMIXER (manufactured by Tokushu Kika Kogyo Co., Ltd.), NATIONAL COOKING MIXER (manufactured by Matsushita Electric Works Ltd.), CLEARMIX (manufactured by $M_{TECHNIQUE}$ Co., Ltd.) and FILMICS (manufactured by Tokushu Kika Kogyo Co., Ltd.). A particularly preferred stirrer includes CLEARMIX (manufactured by $M_{TECHNIQUE}$ Co., Ltd.).

It is preferable that at least one of the colorant composition and the aqueous medium contains a polymerization initiator and at least one of decomposition products of the polymerization initiator is nitrogen or carbon dioxide.

The carbon dioxide has a good solubility in the aqueous medium. Hence, even when it comes as a decomposition product, it almost dissolves in the aqueous medium, and hence it cannot easily come into a gas and cannot easily cause the changes in pressure at the air layer portion of the liquid enclosure tank. Therefore, the pressure during the granulation can be kept constant with ease.

The nitrogen does not change the pH of the aqueous medium even when it comes as a decomposition product. Therefore, the pH of the liquid in the interior of the granulation tank can be kept constant with ease.

The process for producing toner particles according to the present invention may also preferably be used in a process for producing magnetic toner particles. As to a magnetic material used when the magnetic toner particles are produced, it is described below.

It is preferable for the magnetic material used in the magnetic toner in the present invention, to have been made hydrophobic on their particle surfaces. When the magnetic material is made hydrophobic, it is very preferable to use a method of making surface treatment in an aqueous medium while dispersing magnetic-material particles so as to have a primary particle diameter and hydrolyzing a coupling agent. This method of hydrophobic treatment may less cause the mutual coalescence of magnetic-material particles than any treatment made in a gaseous phase. Also, charge repulsion acts between magnetic-material particles themselves as a result of hydrophobic treatment, and hence the magnetic material is surface-treated substantially in the state of primary particles.

The method of surface-treating the magnetic-material particles while hydrolyzing the coupling agent in an aqueous medium does not require any use of coupling agents which may generate gas as in chlorosilanes and silazanes, and also enables use of highly viscous coupling agents which tend to cause mutual coalescence of magnetic-material particles in a gaseous phase and, hence, have always made it difficult to provide good treatment. Thus, a great effect is obtainable by imparting hydrophobicity.

The coupling agent usable in the surface treatment of the magnetic material according to the present invention may include, e.g., silane coupling agents and titanium coupling agents. More preferably used are silane coupling agents, which are those represented by the following formula:

$$R_mSiY_n$$

wherein R represents an alkoxyl group; m represents an integer of 1 or more and 3 or less; Y represents a hydrocarbon group such as an alkyl group, a vinyl group, a glycidoxyl group or a methacrylic group; and n represents an integer of 1 or more and 3 or less.

The silane coupling agents may include, e.g., the following:

Vinyltrimethoxysilane, vinyltriethoxysilane, vinyltris(β-methoxyethoxy)silane, β-(3,4-epoxycyclohexyl)ethyltrimethoxysilane, γ-glycidoxypropyltrimethoxysilane, γ-glycidoxypropylmethyldiethoxysilane, γ-aminopropyltriethoxysilane, N-phenyl-γ-aminopropyltrimethoxysilane, γ-methacryloxypropyltrimethoxysilane, vinyltriacetoxysilane, methyltrimethoxysilane, dimethyldimethoxysilane, phenyltrimethoxysilane, diphenyldimethoxysilane, methyltriethoxysilane, dimethyldiethoxysilane, phenyltriethoxysilane, diphenyldiethoxysilane, n-butyltrimethoxysilane, isobutyltrimethoxysilane, trimethylmethoxysilane, hyroxypropyltrimethoxysilane, n-hexadecyltrimethoxysilane and n-octadecyltrimethoxysilane.

Of these, silane coupling agents having a double bond may preferably be used in order to improve the dispersibility of the magnetic material, and more preferred are phenyltrimethoxysilane, γ-methacryloxypropyltrimethoxysilane and γ-glycidoxypropyltrimethoxysilane. This is considered due to the fact that the treatment with the coupling agent having a double bond makes the magnetic material well fit the polymerizable monomer. This improves the dispersibility of the magnetic material in the toner particles.

However, the use of only the coupling agent having a double bond may make it difficult for the magnetic material to be endowed with a sufficient hydrophobic nature, where, because of an influence by, e.g., the fact that a magnetic material having no sufficient hydrophobic nature comes bare to toner particle surfaces, the toner may inevitably have a broad particle size distribution. The reason therefor is uncertain, and is considered to be because the hydrophobic nature of the coupling agent itself, the reactivity of magnetic-material particle surfaces with active groups and the coatability of magnetic-material particle surfaces are inferior. Hence, an alkyltrialkoxysilane coupling agent represented by the following formula may more preferably be used.

$$C_pH_{2p+1}—Si—(OC_qH_{2q+1})_3$$

wherein p represents an integer of 2 or more and 20 or less, and q represents an integer of 1 or more and 3 or less.

In the above formula, if p is smaller than 2, though hydrophobic treatment may be made with ease, it is difficult to provide a sufficient hydrophobic nature, making it difficult to control the coming-bare of the magnetic-material particles to the magnetic toner particles. If p is larger than 20, though hydrophobic nature can be sufficient, the magnetic-material particles may greatly coalesce one another to make it difficult to disperse the magnetic-material particles sufficiently in the toner particles, tending to make the toner particles have a broad particle size distribution. Also, if q is larger than 3, the silane coupling agent may have a low reactivity to make it difficult for the magnetic material to be made sufficiently hydrophobic.

What is more preferable is to use an alkyltrialkoxysilane coupling agent in which, in the above formula, the p represents an integer of 3 or more and 15 or less and the q represents an integer of 1 or 2.

In the treatment, the silane coupling agent may be used in a total amount of 0.05 part by mass or more and 20 parts by mass or less, preferably 0.1 part by mass or more and 10 parts by mass or less, based on 100 parts by mass of the magnetic material. The amount of such a treating agent may preferably be adjusted in accordance with the surface area of the magnetic-material particles and the reactivity of the coupling agent.

The aqueous medium is meant to be a medium composed chiefly of water. Stated specifically, it may include water itself, water to which a surface-active agent has been added in a small quantity, water to which a pH adjuster has been added, and water to which an organic solvent has been added. As the surface-active agent, a nonionic surface-active agent such as polyvinyl alcohol is preferred. The surface-active agent may be added in an amount of 0.1% by mass or more and 5% by mass or less based on the water. The pH adjuster may include inorganic acids such as hydrochloric acid. The organic solvent may include alcohols.

Incidentally, where plural kinds of silane coupling agents are used, the plural kinds of silane coupling agents may be introduced simultaneously or at intervals of time to treat the magnetic material.

In the magnetic material thus obtained, no agglomeration of particles is seen and the surfaces of individual particles have uniformly been hydrophobic-treated. Hence, the magnetic material can have a good dispersibility in the polymerized monomer.

The magnetic material used in the toner of the present invention may contain any of elements such as phosphorus, cobalt, nickel, copper, magnesium, manganese, aluminum and silicon. The magnetic material is also chiefly composed of an iron oxide such as triiron tetraoxide or γ-iron oxide. Any of these may be used alone or in combination of two or more types. Any of these magnetic materials may preferably have a BET specific surface area, as measured by nitrogen gas absorption, of 2 $m^2/g$ or more and 30 $m^2/g$ or less, and particularly 3 $m^2/g$ or more and 28 $m^2/g$ or less, and also may preferably have a Mohs hardness of 5 or more and 7 or less.

The magnetic material used in the toner of the present invention may preferably be used in an amount of 10 parts by mass or more and 200 parts by mass or less based on 100 parts by mass of the binder resin. It may more preferably be used in an amount of 20 parts by mass or more and 180 parts by mass or less. If it is less than 10 parts by mass, the toner may have a low coloring power, and also make it difficult to keep fog from being caused. If on the other hand it is more than 200 parts by mass, the toner obtained may be held on the toner carrying member by magnetic force so strongly as to have a low developing performance. Further, not only is it difficult for the magnetic material to be uniformly dispersed in individual toner particles, but also the toner may have a low fixing performance.

Incidentally, the content of the magnetic material in the toner may be measured with a thermal analyzer TGA7, manufactured by Perkin-Elmer Corporation. As a measuring method, the toner is heated at a heating rate of 25° C./minute from normal temperature to 900° C. in an atmosphere of nitrogen. The weight loss percent by mass in the course of from 100 to 750° C. is regarded as the binder resin weight, and the residual weight is approximately regarded as the magnetic-material weight.

The magnetic material used in the magnetic toner according to the present invention is, in the case of magnetite for example, produced in the following way. To an aqueous ferrous salt solution, an alkali such as sodium hydroxide is added in an equivalent weight, or more than equivalent weight, with respect to the iron component to prepare an aqueous solution containing ferrous hydroxide. Into the aqueous solution thus prepared, air is blown while its pH is maintained at pH 7 or above (preferably a pH of 8 or more and 14 or less), and the ferrous hydroxide is made to undergo oxidation reaction while the aqueous solution is heated at 70° C. or more to first form seed crystals serving as cores of magnetic ion oxide particles.

Next, to a slurry-like liquid containing the seed crystals, an aqueous solution containing ferrous sulfate in about one equivalent weight on the basis of the quantity of the alkali previously added is added. The reaction of the ferrous hydroxide is continued while the pH of the liquid is maintained at 6 or more and 14 or less and air is blown, to cause magnetic iron oxide particles to grow about the seed crystals as cores. With progress of oxidation reaction, the pH of the liquid comes to shift to acid side, but it is preferable for the pH of the liquid not to be made less than 6. At the termination of the oxidation reaction, the pH is adjusted, and the liquid is thoroughly stirred so that the magnetic iron oxide particles become primary particles. Then the coupling agent is added, and the mixture obtained is thoroughly mixed and stirred, followed by filtration, drying, and then light disintegration to obtain magnetic iron oxide particles having been hydrophobic-treated. Alternatively, the iron oxide particles obtained after the oxidation reaction is completed, followed by washing and filtration, may be again dispersed in a different aqueous medium without drying, and thereafter the pH of the dispersion again formed may be adjusted, where the silane coupling agent may be added with thorough stirring, to make coupling treatment. In any case, it is essential to carry out surface treatment without going through any drying step after the oxidation reaction has been completed, and this is one of the important points in the present invention.

As the ferrous salt, it is possible to use iron sulfate commonly formed as a by-product in the manufacture of titanium by the sulfuric acid method, or iron sulfate formed as a by-product as a result of surface washing of steel sheets, and it is also possible to use iron chloride or the like.

Where iron sulfate is used in the process of producing the magnetic iron oxide by the aqueous solution method, taking account of preventing viscosity from increasing at the time of reaction and because of solubility of the iron sulfate, its aqueous solution is commonly used in an iron concentration of 0.5 mol/l or higher and 2 mol/l or lower. Commonly, the lower the concentration of iron sulfate is, the finer particle size the products tend to have. Also, in the reaction, the more the air is and the lower the reaction temperature is, the finer particles tend to be formed.

Use of the magnetic toner having as a material the hydrophobic magnetic-material particles produced in this way makes it possible to attain a stable toner chargeability and to achieve a high transfer efficiency and also a high image quality and a high stability.

The magnetic material obtained as described above may preferably be used also as the colorant to be contained in the toner particles. As colorants other than the above magnetic material preferably usable in the toner produced in the present invention, they may include carbon black, and yellow colorants, magenta colorants and cyan colorants shown below.

As colorants preferable for yellow color, pigments or dyes may be used, which may specifically include the following: As pigments, C.I. Pigment Yellow 1, 2, 3, 4, 5, 6, 7, 10, 11, 12, 13, 14, 15, 17, 23, 62, 65, 73, 74, 81, 83, 93, 94, 95, 97, 98, 109, 110, 111, 117, 120, 127, 128, 129, 137, 138, 139, 147, 151, 154, 167, 168, 174, 176, 180, 181, 183 and 191; and C.I., Vat Yellow 1, 3 and 20; and as dyes, C.I. Solvent Yellow 19, 44, 77, 79, 81, 82, 93, 98, 103, 104, 112 and 162. Any of these colorants may be used alone or in combination of two or more types.

As colorants preferable for magenta color, pigments or dyes may be used, which may specifically include the following: As pigments, C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48, 48:2, 48:3, 48:4, 49, 50, 51, 52, 53, 54, 55, 57, 57:1, 58, 60, 63, 64, 68, 81, 81:1, 83, 87, 88, 89, 90, 112, 114, 122, 123, 144, 146, 150, 163, 166, 169, 177, 184, 185, 202, 206, 207, 209, 238 and 254; C.I. Pigment Violet 19; and C.I. Vat Red 1, 2, 10, 13, 15, 23, 29 and 35; and as dyes, oil-soluble dyes such as C.I. Solvent Red 1, 3, 8, 23, 24, 25, 27, 30, 49, 52, 58, 63, 81, 82, 83, 84, 100, 109, 111, 121 and 122, C.I. Disperse Red 9, C.I. Solvent Violet 8, 13, 14, 21 and 27, and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39 and 40, and C.I. Basic Violet 1, 3, 7, 10, 14, 15, 21, 25, 26, 27 and 28. Any of these colorants may be used alone or in combination of two or more types.

As colorants preferable for cyan color, pigments or dyes may be used, which may specifically include the following: As pigments, C.I. Pigment Blue 1, 7, 15, 15:1, 15:2, 15:3, 15:4, 16, 17, 60, 62 and 66, C.I. Vat Blue 6 and C.I. Acid Blue 45; and as dyes, C.I. Solvent Blue 25, 36, 60, 70, 93 and 95. Any of these colorants may be used alone or in combination of two or more types.

Any of these colorants may be used alone, in the form of a mixture, or in the state of a solid solution. The colorants used in the present invention are selected taking account of hue angle, chroma, brightness, weatherability, transparency on OHP films and dispersibility in toner particles. The colorant may preferably be added in an amount of 1 part by mass or more and 20 parts by mass or less based on 100 parts by mass of the binder resin.

The toner produced in the present invention may contain a release agent. The release agent usable in the toner particles in the present invention may include the following: Petroleum waxes and derivatives thereof such as paraffin wax, microcrystalline wax and petrolatum, montan wax and derivatives thereof, hydrocarbon waxes obtained by Fischer-Tropsch synthesis and derivatives thereof, polyolefin waxes typified by polyethylene wax and derivatives thereof, and naturally occurring waxes such as carnauba wax and candelilla wax and derivatives thereof. The derivatives include oxides, block copolymers with vinyl monomers, and graft modified products. Also usable are higher aliphatic alcohols, fatty acids such as stearic acid and palmitic acid, or compounds thereof, acid amide waxes, ester waxes, ketones, hardened castor oil and derivatives thereof, vegetable waxes, and animal waxes.

As specific examples, the wax usable as the release agent may include the following: VISKOL (registered trademark) 330-P, 550-P, 660-P, TS-200 (available from Sanyo Chemical Industries, Ltd.); HIWAX 400P, 200P, 100P, 410P, 420P, 320P, 220P, 210P, 110P (available from Mitsui Chemicals, Inc.); SASOL H1, H2, C80, C105, C77 (available from Schumann Sasol Co.); HNP-1, HNP-3, HNP-9, HNP-10, HNP-11, HNP-12 (available from Nippon Seiro Co., Ltd.); UNILIN (registered trademark) 350, 425, 550, 700, UNICID (registered trademark) 350, 425, 550, 700 (available from Toyo-Petrolite Co., Ltd.); and japan wax, bees wax, rice wax, candelilla wax, carnauba wax (available from CERARICA NODA Co., Ltd.).

The toner particles produced in the present invention may be mixed with a charge control agent. As the charge control agent, any known charge control agent may be used. Further, in the case when the toner particles are directly produced by the polymerization process, particularly preferred are charge control agents having a low polymerization inhibitory action and substantially free of any solubilizate to the aqueous dispersion medium. As specific compounds, they may include the following: As negative charge control agents, metal compounds of aromatic carboxylic acids such as salicylic acid, alkylsalicylic acids, dialkylsalicylic acids, naphthoic acid and dicarboxylic acids; metal salts or metal complexes of azo dyes or azo pigments; polymer type compounds having sulfonic acid or carboxylic acid in the side chain; as well as boron compounds, urea compounds, silicon compounds, and calixarene; and, as positive charge control agents, quaternary ammonium salts, polymer type compounds having such a quaternary ammonium salt in the side chain, guanidine compounds, Nigrosine compounds and imidazole compounds.

As methods for making the toner contain the charge control agent, a method of adding it internally to the toner particles and a method of adding it externally to the toner particles are available. The quantity of the charge control agent to be used depends on the type of the binder resin, the presence of any other additives, and the manner by which the toner is produced, inclusive of the manner of dispersion, and cannot absolutely be specified. When added internally, the charge control agent may be used in an amount ranging of 0.1 part by mass or more and 10 parts by mass or less, and more preferably 0.1 part by mass or more and 5 parts by mass or less, based on 100 parts by mass of the binder resin. Also, when added externally, the charge control agent may preferably be added in an amount of 0.005 part by mass or more and 1.0 part by mass or less, and more preferably 0.01 part by mass or more and 0.3 part by mass or less, based on 100 parts by mass of the toner particles.

The polymerizable monomer constituting the toner particles produced in the present invention may include the following.

The polymerizable monomer may include styrene monomers such as styrene, o-methylstyrene, m-methylstyrene, p-methylstyrene, p-methoxystyrene and p-ethylstyrene; acrylic esters such as methyl acrylate, ethyl acrylate, n-butyl acrylate, isobutyl acrylate, n-propyl acrylate, n-octyl acrylate, dodecyl acrylate, 2-ethylhexyl acrylate, stearyl acrylate, 2-chloroethyl acrylate and phenyl acrylate; methacrylic esters such as methyl methacrylate, ethyl methacrylate, n-propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate and diethylaminoethyl methacrylate; and other monomers such as acrylonitrile, methacrylonitrile and acrylamides.

In the toner particle production process of the present invention, the polymerization may be carried out by adding a resin to the polymerizable monomer. For example, a monomer component containing a hydrophilic functional group such as an amino group, a carboxylic group, a hydroxyl group, a sulfonic acid group, a glycidyl group or a nitrile group, which can not be used because it is water-soluble as a monomer and hence dissolves in an aqueous suspension to cause emulsion polymerization should be introduced into toner particles, it may be used in the form of a copolymer such as a random copolymer, a block copolymer or a graft copolymer, of any of these with a vinyl compound such as styrene or ethylene, in the form of a polycondensation product such as polyester or polyamide, or in the form of a polyaddition product such as polyether or polyimine.

An alcohol component and an acid component which constitute a polyester resin used in its addition to the above polymerizable monomer are exemplified below.

As the alcohol component, it may include ethylene glycol, propylene glycol, 1,3-butanediol, 1,4-butanediol, 2,3-butanediol, diethylene glycol, triethylene glycol, 1,5-pentanediol, 1,6-hexanediol, neopentyl glycol, 2-ethyl-1,3-hexanediol, cyclohexane dimethanol, butenediol, octenediol, cyclohexene dimethanol, hydrogenated bisphenol A, a bisphenol derivative represented by the following Formula (I) or a hydrogenated product of the compound represented by the following Formula (I):

(I)

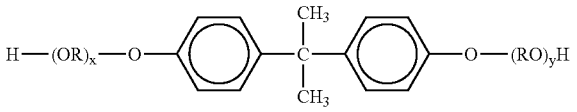

wherein R represents an ethylene group or a propylene group, x and y are each an integer of 1 or more, and an average value of x+y is 2 to 10;

and a diol represented by the following Formula (II) or a hydrogenated product of the compound represented by Formula (II):

(II)

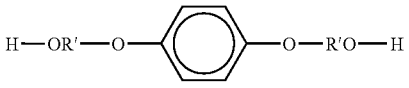

wherein R′ represents $-CH_2CH_2-$, $-CH_2CH(CH_3)-$, or $-CH_2-C(CH_3)_2-$.

As a dibasic carboxylic acid, it may include the following: Benzene dicarboxylic acids or anhydrides thereof, such as phthalic acid, terephthalic acid, isophthalic acid and phthalic anhydride; alkyldicarboxylic acids such as succinic acid, adipic acid, sebacic acid and azelaic acid, or anhydrides thereof, or succinic acid or its anhydride, substituted with an alkyl or alkenyl group having 6 carbon atoms or more and 18 carbon atoms or less; and unsaturated dicarboxylic acids such as fumaric acid, maleic acid, citraconic acid and itaconic acid, or anhydrides thereof.

The alcohol component may further include the following: Polyhydric alcohols such as glycerol, pentaerythritol, sorbitol, and oxyalkylene ethers of novolak phenol resins; and, as the acid component, polycarboxylic acids such as trimellitic acid, pyromellitic acid, 1,2,3,4-butanetetracarboxylic acid, benzophenonetetracarboxylic acid and anhydrides thereof.

The polyester resin may preferably be composed of 45 mol % or more and 55 mol % or less of the alcohol component and 55 mol % or less and 45 mol % or more of the acid component in the whole components.

In the present invention, as long as physical properties of the toner particles obtained are not adversely affected, it is also preferable to use two or more types of polyester resins in combination or to regulate physical properties of the polyester resin by modifying it with, e.g., a silicone compound or a fluoroalkyl group-containing compound. In the case when a high polymer containing such a polar functional group is used, those having a number-average molecular weight of 5,000 or more may preferably be used.

A resin other than the foregoing may also be added in the monomer composition. The resin usable therefor may include the following: Homopolymers of styrene or derivatives thereof, such as polystyrene and polyvinyltoluene; styrene copolymers such as a styrene-propylene copolymer, a styrene-vinyltoluene copolymer, a styrene-vinylnaphthalene copolymer, a styrene-methyl acrylate copolymer, a styrene-ethyl acrylate copolymer, a styrene-butyl acrylate copolymer, a styrene-octyl acrylate copolymer, a styrene-dimethylaminoethyl acrylate copolymer, a styrene-methyl methacrylate copolymer, a styrene-ethyl methacrylate copolymer, a styrene-butyl methacrylate copolymer, a styrene-dimethylaminoethyl methacrylate copolymer, a styrene-methyl vinyl ether copolymer, a styrene-ethyl vinyl ether copolymer, a styrene-methyl vinyl ketone copolymer, a styrene-butadiene copolymer, a styrene-isoprene copolymer, a styrene-maleic acid copolymer and a styrene-maleate copolymer; and polymethyl methacrylate, polybutyl methacrylate, polyvinyl acetate, polyethylene, polypropylene, polyvinyl butyral, silicone resins, polyester resins, polyamide resins, epoxy resins, polyacrylic acid resins, rosins, modified rosins, terpene resins, phenolic resins, aliphatic or alicyclic hydrocarbon resins, and aromatic petroleum resins. Any of these resins may be used alone or in the form of a mixture.

Any of these resins may preferably be added in an amount of 1 part by mass or more and 20 parts by mass or less based on 100 parts by mass of the monomer. Its addition in an amount of less than 1 part by mass may be low effective. On the other hand, its addition in an amount of more than 20 parts by mass may make it difficult to design various physical properties of the polymerization toner.

A polymer having molecular weight in a range different from that of the molecular weight of the toner particles obtained by polymerizing the monomer may further be dissolved in the monomer to carry out the polymerization.

In the toner particle production process of the present invention, as the polymerization initiator used to initiate the reaction of polymerizing the polymerizable monomer, it may preferably be one having a half-life of 0.5 hour or more and 30 hours or less at the time of polymerization reaction. Also, the polymerization reaction may be carried out with addition of the polymerization initiator in an amount of 0.5 part by mass or more and 20 parts by mass or less based on 100 parts by mass of the polymerizable monomer. This is preferable because a polymer having a maximum molecular weight in the region of molecular weight of 10,000 or more and 100,000 or less can be obtained and this enables the toner to be endowed with a desirable strength and appropriate melt properties.

The polymerization initiator may include the following: Azo type or diazo type polymerization initiators such as 2,2'-azobis-(2,4-dimethylvaleronitrile), 2,2'-azobisisobutyronitrile, 1,1'-azobis-(cyclohexane-1-carbonitrile), 2,2'-azobis-4-methoxy-2,4-dimethylvaleronitrile and azobisisobutyronitrile; and peroxide type polymerization initiators such as benzoyl peroxide, methyl ethyl ketone peroxide, diisopropyl peroxycarbonate, cumene hydroperoxide, 2,4-dichlorobenzoyl peroxide, lauroyl peroxide, and t-butyl peroxy-2-ethylhexanoate.

When the toner particles of the present invention are produced, a cross-linking agent may be added, which may preferably be added in an amount of 0.001 part by mass or more and 15 parts by mass or less based on 100 parts by mass of the polymerizable monomer.

Here, as the cross-linking agent, compounds chiefly having at least two polymerizable double bonds may be used. It may include, e.g., the following: Aromatic divinyl compounds such as divinyl benzene and divinyl naphthalene; carboxylic esters having two double bonds, such as ethylene glycol diacrylate, ethylene glycol dimethacrylate and 1,3-butanediol dimethacrylate; divinyl compounds such as divinyl aniline, divinyl ether, divinyl sulfide and divinyl sulfone; and compounds having at least three vinyl groups. Any of these cross-linking agents may be used alone or in the form of a mixture of two or more types.

In the process for producing toner particles according to the present invention, to carry out the granulation, the colorant composition containing at least a colorant, obtained in the dissolution step, is suspended in an aqueous medium containing a dispersion stabilizer, in the state in which substantially no air layer portion is present. Incidentally, the colorant composition may be prepared by appropriately adding, besides the colorant, the components necessary as toner particles, such as the polymerizable monomer, the release agent, the plasticizer, the charge control agent and the cross-linking agent, and other additives as exemplified by an organic solvent, a high polymer and a dispersing agent which are added in order to lower the viscosity of the polymer formed by the polymerization reaction.

At the same time the colorant composition is granulated in this way, or after it has been granulated, the polymerization initiator is added to carry out polymerization of the colorant composition (polymerization step). As the time at which the polymerization initiator is added, it may be added simultaneously when other additives are added to the polymerizable monomer, or may be added immediately before the colorant composition is suspended in the aqueous medium. Also, a polymerization initiator having been dissolved in the polymerizable monomer or in a solvent may be added immediately after granulation and before the polymerization reaction is initiated.

After the granulation, agitation may be carried out using a usual agitator, to such an extent that the state of particles is maintained and also the particles can be prevented from floating and settling.

In the process for producing toner particles according to the present invention, any known surface-active agent or organic or inorganic dispersant may be used as a dispersion stabilizer. In particular, the inorganic dispersant cannot easily cause any harmful ultrafine powder and they attain dispersion stability on account of its steric hindrance. Hence, even when reaction temperature is changed, it cannot easily lose the stability, can be washed with ease and may hardly adversely affect toners, and hence it may preferably be used. As examples of such an inorganic dispersant, it may include the following: Phosphoric acid polyvalent metal salts such as calcium phosphate, magnesium phosphate, aluminum phosphate and zinc phosphate; carbonates such as calcium carbonate and magnesium carbonate; inorganic salts such as calcium metasilicate, calcium sulfate and barium sulfate; and inorganic hydroxides such as calcium hydroxide, magnesium hydroxide and aluminum hydroxide; and inorganic oxides such as silica, bentonite and alumina.

Any of these inorganic dispersants may preferably be used alone in an amount of 0.2 part by mass or more and 20 parts by mass or less based on 100 parts by mass of the polymerizable monomer. In order to make the ultrafine particles not easily formed and also make the toner particles into finer particles, a surface-active agent may be used in combination in an amount of 0.001 part by mass or more and 0.1 part by mass or less based on 100 parts by mass of the polymerizable monomer.

Such a surface-active agent may include, e.g., the following: Sodium dodocylbenzenesulfonate, sodium tetradecyl sulfate, sodium pentadecyl sulfate, sodium octyl sulfate, sodium oleate, sodium laurate, sodium stearate and potassium stearate.

When these inorganic dispersants are used, they may be used as they are. In order to obtain finer particles, particles of the inorganic dispersant may be formed in the aqueous medium. For example, in the case of calcium phosphate, an aqueous sodium phosphate solution and an aqueous calcium chloride solution may be mixed under high-speed stirring, whereby water-insoluble calcium phosphate can be formed and more uniform and finer dispersion can be effected. Here, water-soluble sodium chloride is simultaneously formed as a by-product. However, the presence of such a water-soluble salt in the aqueous medium keeps the polymerizable monomer from dissolving in water to make any ultrafine toner particles not easily formed by emulsion polymerization, and hence this is more favorable. Since its presence may be an obstacle when residual polymerizable monomers are removed at the termination of polymerization reaction, it is better to exchange the aqueous medium or desalt it with an ion-exchange resin. The inorganic dispersant can substantially completely be removed by dissolving it with an acid or an alkali after the polymerization is completed.

In the step of polymerization, the polymerization may be carried out at a polymerization temperature set at 40° C. or above, and commonly at a temperature of 50° C. or higher and 90° C. or lower. When polymerization is carried out within this temperature range, the release agent or wax to be enclosed inside the toner particles is deposited by phase separation to become enclosed more perfectly. In order to consume residual polymerizable monomers, the reaction temperature may be raised to 90 to 150° C. if it is done at the termination of polymerization reaction.

After the polymerization is completed, the polymerization particles obtained are filtered, washed and then dryed by known methods. The resultant polymerization particles are put to the step of classification, where any coarse powder and fine powder with particle diameter outside the desired range are removed, thus the toner particles are obtained. Incidentally, the classification step may be carried out by any known method used conventionally in the production of toners, without any particular limitations. The toner particles (toner base particles) obtained through the classification step may be mixed with external additives such as an inorganic fine powder to make it adhere to the toner particle surfaces, to obtain a toner. The step of classification may also be added to the production process to remove any coarse powder and fine powder. This is also a desirable embodiment of the present invention.

In the present invention, of the external additives, an inorganic fine powder having a number-average primary particle diameter of 4 nm or more and 80 nm or less may be added to the toner as a fluidizing agent. This is also a preferred embodiment.

As the inorganic fine powder used in the present invention, usable are fine powders of silica, alumina, titanium oxide and so forth. For example, as the fine silica powder, usable are what is called dry-process silica or fumed silica produced by vapor phase oxidation of silicon halides and what is called wet-process silica produced from water glass or the like, either of which may be used. In particular, the dry-process silica is preferred, as having less silanol groups present on the particle surfaces and interiors of the fine silica powder and leaving less production residues such as $Na_2O$ and $SO_3^{2-}$. Also, in the case of the dry-process silica, in the production step therefor, other metal halides such as aluminum chloride or titanium chloride, for example, may be used together with the silicon halide to obtain a composite fine powder of silica with other metal oxide. The dry-process silica includes these as well.

The inorganic fine powder having a number-average primary particle diameter of 4 nm or more and 80 nm or less may preferably be added in an amount of 0.1% by mass or more and 3.0% by mass or less based on the weight of the toner base particles. In its addition in an amount of less than 0.1% by mass, the effect to be brought by its addition may be insufficient. Its addition in an amount of more than 3.0% by mass may make the toner have a poor fixing performance. Incidentally, the content of the inorganic fine powder may be determined by fluorescent X-ray analysis and using a calibration curve prepared from a standard sample.

Taking account of properties in a high-temperature and high-humidity environment, the inorganic fine powder may preferably be a powder having been hydrophobic-treated. As a treating agent used for such hydrophobic treatment, usable are a silicone varnish, a modified silicone varnish of various types, a silicone oil, a modified silicone oil of various types, a silane compound, a silane coupling agent, other organosilicon compounds and an organotitanium compound; any of which may be used alone or in combination.

As a method for such treatment of the inorganic fine powder, for example, a method is available in which silylation reaction is effected as first-stage reaction to cause silanol groups to disappear by chemical coupling, and thereafter, as second-stage reaction, the silicone oil is added to form hydrophobic thin films on particle surfaces.

The silicone oil may preferably be one having a viscosity at 25° C. of 10 $mm^2/s$ or more and 200,000 $mm^2/s$ or less, and more preferably from 3,000 $mm^2/s$ or more and 80,000 $mm^2/s$ or less. If its viscosity is less than 10 $mm^2/s$, the inorganic fine powder may have no stability, and the image quality tends to lower because of thermal and mechanical stress. If its viscosity is more than 200,000 $mm^2/s$, it tends to be difficult to make uniform treatment.

As the silicone oil used, particularly preferred are, e.g., dimethylsilicone oil, methylphenylsilicone oil, α-methylstyrene modified silicone oil, chlorophenylsilicone oil and fluorine modified silicone oil.

As a method for treating the inorganic fine powder with the silicone oil, for example, a fine silica powder having been treated with a silane compound and the silicone oil may directly be mixed by means of a mixer such as Henschel mixer, or a method may be used in which the silicone oil is sprayed on the fine silica powder. Alternatively, a method may also be used in which the silicone oil is dissolved or dispersed in a suitable solvent and thereafter the fine silica powder is added thereto and mixed, followed by removal of the solvent. In view of an advantage that agglomerates of the inorganic fine powder may form less, the method making use of a sprayer is preferred.

The silicone oil may be used for the treatment in an amount of 1 part by mass or more and 40 parts by mass or less, and preferably from 3 parts by mass or more and 35 parts by mass or less, based on 100 parts by mass of the inorganic fine powder.

In order for the toner to be provided with a good fluidity, the inorganic fine powder used in the present invention may preferably be one having a specific surface area ranging from 20 $m^2/g$ or more and 350 $m^2/g$ or less, and more preferably from 25 $m^2/g$ or more and 300 $m^2/g$ or less, as measured by the BET method utilizing nitrogen absorption.

The specific surface area is measured according to the BET method, where nitrogen gas is adsorbed on sample surfaces using a specific surface area measuring device AUTOSOBE 1 (manufactured by Yuasa Ionics Co.), and the specific surface area is calculated by the BET multiple point method.

In order to improve cleaning performance and so forth, the toner may preferably contain inorganic or organic closely spherical fine particles having a primary particle diameter of more than 30 nm, and more preferably a primary particle diameter of more than 50 nm, which may be added to the toner particles as an external additive. As the inorganic or organic fine particles, preferably usable are those having a specific surface area of less than 50 $m^2/g$ (more preferably having a specific surface area of less than 30 $m^2/g$). As such fine particles, preferably usable are, e.g., spherical silica particles, spherical polymethyl silsesquioxane particles and spherical resin particles.

In the toner used in the present invention, other external additives may further be used in their addition to the toner particles (toner base particles) as long as they substantially do not adversely affect the toner. Such external additives may include, e.g., the following: Lubricant powders such as polyethylene fluoride powder, zinc stearate powder and polyvinylidene fluoride powder; abrasives such as cerium oxide powder, silicon carbide powder and strontium titanate powder; fluidity-providing agents such as titanium oxide powder and aluminum oxide powder; and caking preventives. Also usable are reverse-polarity organic fine particles or inorganic fine particles which may be used in a small quantity as a developability improver. These additives may also be used after hydrophobic treatment of their particle surfaces.

The toner that can be produced in the present invention may be used as a one-component developer. For example, as the one-component developer, in the case of a polymerization toner containing the magnetic material in the toner particles, a method is available in which the polymerization toner is transported and triboelectrically charged by the aid of a magnet built-in provided in a developing sleeve. However, the toner is not necessarily required to be limited to such a one-component developer, and may also be used as a two-component developer.

In the case when the toner is used as the two-component developer, a magnetic carrier is used together with the toner. The magnetic carrier may be made up using any element selected from iron, copper, zinc, nickel, cobalt, manganese and chromium, solely or in the state of a composite ferrite. As the particle shape of the magnetic carrier, it may be spherical, flat or shapeless (amorphous). It is also preferable to control the microstructure of magnetic carrier particle surface state (e.g., surface unevenness). What is commonly used is a method in which an inorganic oxide of the foregoing is fired and granulated to beforehand produce magnetic carrier core particles, and the magnetic carrier core particles are thereafter coated with a resin. For the purpose of lessening the load of magnetic carrier to toner, it is also possible to use a method in which the inorganic oxide and the resin are kneaded, followed by pulverization and then classification to obtain a low-density dispersed carrier, or a method in which a kneaded product of the inorganic oxide and monomers is directly subjected to suspension polymerization in an aqueous medium to obtain a truly spherical magnetic carrier.

Of these, a coated carrier obtained by coating the surfaces of the above carrier core particles with a resin is particularly preferred. As methods for coating the surfaces of the carrier core particles with a resin, applicable are a method in which a resin dissolved or suspended in a solvent is coated to make it adhere to carrier core particles, and a method in which a resin powder and the carrier core particles are merely mixed to make the former adhere to the latter.

The material made to adhere to the carrier particle surfaces may differ depending on toner materials. For example, it may include the following: Polytetrafluoroethylene, monochlorotrifluoroethylene polymer, polyvinylidene fluoride, silicone resins, polyester resins, styrene resins, acrylic resins, polyamide, polyvinyl butyral, and aminoacrylate resins. Any of these may be used alone or in combination of two or more types.

The carrier may be those having the following magnetic characteristics: Its magnetization intensity ($\sigma_{1000}$) under application of a magnetic-field intensity of 79.6 kA/m (1,000 oersteds) after it has magnetically been saturated may preferably be from 3.77 μWb/cm$^3$ or more and 37.7 m μb/cm$^3$ or less. In order to achieve a much higher image quality, it may more preferably be 12.6 μWb/cm$^3$ or more and 31.4 μWb/cm$^3$ or less. If this magnetization intensity is more than 37.7 μWb/cm$^3$, it may be difficult to obtain toner images having a high image quality. If on the other hand it is less than 3.77 μWb/cm$^3$, the carrier may also have less magnetic binding force to tend to cause carrier adhesion.

In the case when the toner used in the present invention is blended with the magnetic carrier to prepare the two-component developer, they may be blended in a ratio such that the toner in the developer is in a concentration of 2% by mass or more and 15% by mass or less, and preferably 4% by mass or more and 13% by mass or less, where good results can usually be obtained.

A measuring method used in the present invention is described below.

Measurement of weight-average particle diameter of toner and calculation of number-base coefficient of variation:

The average particle diameter and particle size distribution of the toner may be measured by various methods making use of Coulter Counter TA-II Model or Coulter Multisizer (manufactured by Coulter Electronics, Inc.). In the present invention, Coulter Multisizer (manufactured by Coulter Electronics, Inc.) is used. An interface (manufactured by Nikkaki Bios Co., Ltd.) that outputs number distribution and volume distribution and a personal computer PC9801 (manufactured by NEC Corporation) are connected. As an electrolytic solution, an aqueous 1% NaCl solution is prepared using first-grade sodium chloride. For example, ISOTON R-II (available from Coulter Scientific Japan Co.) may be used as such an electrolytic solution.

Measurement is made by the following procedure. As a dispersant, 0.1 to 5 ml of a surface-active agent, preferably an alkylbenzene sulfonate, is added to 100 to 150 ml of the above aqueous electrolytic solution, and 2 to 20 mg of a measuring sample is further added. The electrolytic solution in which the sample has been suspended is subjected to dispersion treatment for about 1 minute to about 3 minutes in an ultrasonic dispersion machine. The volume distribution and number distribution are calculated by measuring the volume and number of toner particles of 2 μm or more in particle diameter by means of the above Coulter Multisizer, using an aperture of 100 μm as its aperture.

Then, the volume-base weight-average particle diameter (D4: the middle value of each channel is used as the representative value for each channel) determined from the volume distribution, the number-base length-average particle diameter (D1) determined from the number distribution, and the number coefficient of variation are determined which are concerned with the present invention.

The number coefficient of variation is represented by the following expression (6). In the following expression (6), S represents the standard deviation in the volume distribution of toner particles, and D1 represents the number-average particle diameter (μm) of the toner particles. More specifically, it shows that, the smaller the value of the coefficient of variation is, the sharper the particle size distribution of the toner particles is, and that, the larger that value is, the broader the particle size distribution is.

$$\text{Number coefficient of variation (\%)} = (S/D1) \times 100 \quad (6)$$

EXAMPLES

The present invention is described below in greater detail by giving Examples, which, however, by no means limit the present invention.

Example 1

Toner particles were produced according to the flow chart shown in FIG. 1.

An aqueous dispersion medium and a colorant composition were prepared in the following way. Also, the total amount of the dispersion medium and toner components shown below were beforehand so calculated as to be 90% of the internal volume of the granulation tank.

Preparation of Aqueous Dispersion Medium:

In the granulation tank 3 having the internal volume of 200 L, having a granulation stirrer 4 (CLEARMIX, manufactured by $M_{TECHNIQUE}$ Co., LTD.), the following components were mixed, and then heated to 60° C., followed by stirring at 35 m/s.

| | (by mass) |
|---|---|
| Water | 950 parts |
| Aqueous 0.1 mol/liter $Na_3PO_4$ solution | 450 parts |

Next, the interior of the tank was displaced with nitrogen and also 68 parts by mass of an aqueous 1.0 mol/liter $CaCl_2$ solution was added thereto to carry out reaction to obtain an aqueous dispersion medium containing fine particles of calcium phosphate.

Preparation of Colorant Dispersion (Dispersion Step):

| | (by mass) |
|---|---|
| Styrene | 145 parts |
| Colorant (C.I. Pigment Red 150) | 14 parts |

In a media type dispersion machine attritor, 25 kg of media (made of zirconia) of 1 mm in diameter were filled (fill: 55%), and thereafter the above components were introduced thereinto. These were subjected to dispersion for 5 hours in the state of atmospheric pressure to obtain a colorant dispersion. The colorant dispersion obtained after they were dispersed was sampled, and how the pigment stood dispersed was observed on an optical microscope. As the result, a good state of dispersion was ascertained.

Preparation of Colorant Composition (Dissolution Step):

| | (by mass) |
|---|---|
| 2-Ethylhexyl acrylate | 35 parts |
| Salicylic acid aluminum compound (BONTRON E-88, available from Orient Chemical Industries, Ltd.) | 2 parts |
| Terephthalic acid-propylene oxide modified bisphenol A (acid value: 10 mgKOH/g; weight-average molecular weight: 7,500) | 10 parts |
| Divinylbenzene | 0.3 part |
| Ester wax (Maximum endothermic peak temperature in DSC: 72° C.) | 25 parts |

120 parts by mass of the above colorant dispersion was transferred to the dissolution tank 1. The dissolution stirrer 2 is one having paddle blades as the stirring blades. Further, in addition to the colorant dispersion, the above components were introduced, and these were heated to 60° C. over a period of 30 minutes, during which the stirring blades were rotated at 1.5 rps to start stirring. This operation was continued also after the temperature of the materials being treated reached 60° C., where, after a lapse of 60 minutes, a colorant composition was obtained.

Granulation Step and Polymerization Step:

The peripheral speed of the granulation stirrer 4 (CLEARMIX) was changed to 20 m/s, and thereafter the dissolution discharge valve 11 and the granulation tank valve (1) 14 were opened to add the colorant composition to the granulation tank 3 holding therein the aqueous dispersion medium. After its addition, the dissolution discharge valve 11 and the granulation tank valve (1) 14 were closed and the liquid enclosure discharge valve 12 and the granulation tank valve (2) 15 were opened. Then, an initiator solution was introduced which was beforehand kept prepared in the liquid enclosure tank 5 by dissolving 6 parts by mass of 2,2'-azobis (2,4-dimethylvaleronitrile) in 20 parts by mass of styrene. After the initiator solution was discharged, the hot-water shower line 17 was opened to start the feeding of 60° C. hot water to the granulation tank 3 through the liquid enclosure tank 5. At the time the hot water collected to a level of 10% of the internal volume of the liquid enclosure tank 5, the feeding of the hot water was stopped.

The inner cylinder 16, extending from the lower part of the granulation tank valve 15 toward the interior of the granulation tank 3, was also beforehand installed in such a way that the proportion of the granulation tank air layer portion to the granulation tank internal volume was 1% (B/A=0.01). Thus, the air layer portion was present by 1% in the interior of the granulation tank 3.

Thereafter, the pressure control valve 10 positioned at the upper part of the liquid enclosure tank 5 was opened to feed nitrogen to the interior of the liquid enclosure tank 5, where the gauge pressure at the air layer portion of the liquid enclosure tank 5 was measured with the pressure gauge 9 to find that it was 190 kPa. After the interior of the liquid enclosure tank 5 was pressurized, the peripheral speed of the granulation stirrer was again changed to 35 m/s, and the granulation was carried out for 22 minutes.

After the granulation was completed, the granulation discharge valve 13 was opened to transfer the treated product into the polymerization tank 7 having the paddle stirring blades, and the polymerization was continued at an internal temperature of 60° C. After 6 hours, the polymerization temperature was raised to 80° C., and stirring with heating was continued for 3 hours, where the polymerization was completed.

After the polymerization was completed, the slurry formed was sampled in a small quantity. Then the particle size distribution was measured, and the number coefficient of variation was calculated to make evaluation according to the following evaluation criteria. This number coefficient of variation shows that, the smaller the value is, the sharper the particle size distribution is and the better the granulation performance is.

Evaluation Criteria of Number Coefficient of Variation (Granulation Performance)

A: Less than 22.0%.

B: From 22.0% or more to less than 24.0%.

C: From 24.0% or more to less than 26.0%.

D: 26.0% or more.

The results of evaluation which were obtained on the volume-base weight-average particle diameter D4 and number coefficient of variation are shown in Table 1.

After the polymerization was completed, residual monomers were evaporated off under reduced pressure. The reaction product obtained was cooled, and thereafter dilute hydrochloric acid was added to dissolve the dispersant, followed by solid-liquid separation, washing with water, filtration, drying and then classification to obtain polymerization toner particles as magenta toner particles.

100 parts by mass of the magenta toner particles obtained and 1.5 parts by mass of hydrophobic fine titanium oxide powder having a specific surface area of 100 $m^2/g$ as measured by the BET method were mixed to obtain a negatively triboelectrically chargeable magenta toner.

Evaluation:

With 5 parts by mass of this magenta toner, 95 parts by mass of an acryl-coated ferrite carrier was blended to prepare a two-component developer. Using this developer in a commercially available digital full-color copying machine (CLC500, manufactured by CANON INC.), an image of 2% in print percentage was copied on 5,000 sheets in an environment of normal temperature and normal humidity (23° C./50% RH), and thereafter solid images were outputted to reproduce magenta images. After the image reproduction was completed, image density was measured. To measure the image density, solid images were formed, and that of the solid images was measured with Macbeth Reflection Densitometer (manufactured by Macbeth Co.) to make evaluation according to the following criteria. The results are shown in Table 1.

Evaluation Criteria of Image Density

A: 1.4 or more.

B: Less than 1.4 to 1.2 or more.

C: Less than 1.2.

Example 2

The procedure of Example 1 was repeated to obtain toner particles, except that the gauge pressure at the air layer portion of the liquid enclosure tank in carrying out the granulation in Example 1 was changed to 400 kPa. The same image evaluation as that in Example 1 was made. The results are shown in Table 1.

Example 3

The procedure of Example 1 was repeated to obtain toner particles, except that the peripheral speed of the granulation stirrer 4 in carrying out the granulation in Example 1 was changed to 25 m/s. The same image evaluation as that in Example 1 was made. The results are shown in Table 1.

Example 4

The procedure of Example 1 was repeated to obtain toner particles, except that the peripheral speed of the granulation stirrer 4 in carrying out the granulation in Example 1 was changed to 40 m/s. The same image evaluation as that in Example 1 was made. The results are shown in Table 1.

Example 5

The procedure of Example 1 was repeated to obtain toner particles, except that the peripheral speed of the granulation stirrer 4 in carrying out the granulation in Example 1 was changed to 17 m/s. The same image evaluation as that in Example 1 was made. The results are shown in Table 1.

Example 6

The procedure of Example 1 was repeated to obtain toner particles, except that the inner cylinder 16, extending from the lower part of the granulation tank valve 15 toward the interior of the granulation tank 3, was installed in such a way that the proportion of the granulation tank 3 air layer portion to the granulation tank 3 internal volume was 5% (B/A=0.05). The same image evaluation as that in Example 1 was made. The results are shown in Table 1.

Example 7

The procedure of Example 1 was repeated to obtain toner particles, except that the gauge pressure at the air layer portion of the liquid enclosure tank in carrying out the granulation in Example 1 was changed to 100 kPa. The same image evaluation as that in Example 1 was made. The results are shown in Table 1.

Example 8

The procedure of Example 1 was repeated to obtain toner particles, except that the gauge pressure at the air layer portion of the liquid enclosure tank in carrying out the granulation in Example 1 was changed to 800 kPa. The same image evaluation as that in Example 1 was made. The results are shown in Table 1.

Example 9

The procedure of Example 1 was repeated to obtain toner particles, except that the gauge pressure at the air layer portion of the liquid enclosure tank in carrying out the granulation in Example 1 was changed to 0 kPa. The same image evaluation as that in Example 1 was made. The results are shown in Table 1.

Example 10

The procedure of Example 1 was repeated to obtain toner particles, except that the gauge pressure at the air layer portion of the liquid enclosure tank in carrying out the granulation in Example 1 was changed to 900 kPa. The same image evaluation as that in Example 1 was made. The results are shown in Table 1.

Example 11

The procedure of Example 1 was repeated to obtain toner particles, except that the peripheral speed of the granulation stirrer 4 in carrying out the granulation in Example 1 was changed to 16 m/s. The same image evaluation as that in Example 1 was made. The results are shown in Table 1.

Example 12

The procedure of Example 1 was repeated to obtain toner particles, except that the peripheral speed of the granulation stirrer 4 in carrying out the granulation in Example 1 was changed to 41 m/s. The same image evaluation as that in Example 1 was made. The results are shown in Table 1.

Comparative Example 1

The procedure of Example 1 was repeated to obtain toner particles, except that the inner cylinder 16, extending from the lower part of the granulation tank valve 15 toward the interior of the granulation tank 3, was installed in such a way that the proportion of the granulation tank 3 air layer portion to the granulation tank 3 internal volume was 6% (B/A=0.06). Also, the liquid enclosure tank was not pressurized in carrying out the granulation. The same image evaluation as that in Example 1 was made. The results are shown in Table 1.

TABLE

| | Gauge pressure at liquid enclosure tank air layer portion | Proportion of air layer portion in granulation tank | Stirring blade peripheral speed | Granulation performance | Image density |
|---|---|---|---|---|---|
| Example: | | | | | |
| 1 | 190 | 0.01 | 35 | A | A |
| 2 | 400 | 0.01 | 35 | A | A |
| 3 | 190 | 0.01 | 25 | A | A |
| 4 | 190 | 0.01 | 40 | B | B |
| 5 | 190 | 0.01 | 17 | B | B |
| 6 | 190 | 0.05 | 35 | B | B |
| 7 | 100 | 0.01 | 35 | B | B |
| 8 | 800 | 0.01 | 35 | A | A |
| 9 | 0 | 0.01 | 35 | C | B |
| 10 | 900 | 0.01 | 35 | A | B |
| 11 | 190 | 0.01 | 16 | C | B |
| 12 | 190 | 0.01 | 41 | C | B |
| Comparative Example: | | | | | |
| 1 | 0 | 0.06 | 35 | D | C |

This application claims priority from Japanese Patent Application No. 2005-014974 filed Jan. 24, 2005, which is hereby incorporated by reference herein.

What is claimed is:

1. A process for producing toner particles to be obtained by granulating in an aqueous medium a colorant composition containing at least a colorant, wherein;

an apparatus which forms the toner particles by granulation has a granulation tank and a stirrer, and, where the internal volume of the granulation tank is represented by A (L) and the volume of an air layer portion in the interior of the granulation tank by B (L), the air layer portion proportion B/A satisfies the following expression (1):

$$0.05 \geqq B/A \quad (1),$$

wherein the air layer portion of said liquid enclosure tank is pressurized, wherein gauge pressure C (kPa) at the time the air layer portion of said liquid enclosure tank is pressurized satisfies the following expression (3):

$$100(\text{kPa}) \leqq C \leqq 800(\text{kPa}) \quad (3),$$

wherein said stirrer is constituted of a rotating stirring blade and a stirring chamber and wherein in the step of granulation, said stirring blade is rotated at a peripheral speed of 17 m/sec or more and 40 m/sec or less.

2. The process for producing toner particles according to claim 1, wherein said air layer portion proportion B/A satisfies the following expression (2):

$$0.01 \geqq B/A \quad (2).$$

3. The process for producing toner particles according to claim 1, wherein said colorant composition further contains a polymerizable monomer.

4. The process for producing toner particles according to claim 1, wherein a liquid enclosure tank which communicates with said granulation tank is provided, and a liquid in the liquid enclosure tank is introduced into said granulation tank to feed the liquid to the interior of said granulation tank.

5. The process for producing toner particles according to claim 4, wherein said liquid enclosure tank communicates with the upper part of said granulation tank.

6. The process for producing toner particles according to claim 4, wherein the liquid in said liquid enclosure tank is an aqueous medium.

7. The process for producing toner particles according to claim 4, wherein, where the temperature of a liquid in said granulation tank is represented by D (° C.), and the temperature of a liquid in said liquid enclosure tank by E (° C.), D and E satisfy the following expression (5):

$$(D-30(^\circ\text{C.})) \leqq E \leqq (D+30(^\circ\text{C.})) \quad (5).$$

8. The process for producing toner particles according to claim 1, wherein said colorant composition or said aqueous medium contains a polymerization initiator and at least one of decomposition products of the polymerization initiator is nitrogen or carbon dioxide.

* * * * *